US005813254A

United States Patent [19]

Yang

[11] Patent Number: 5,813,254

[45] Date of Patent: Sep. 29, 1998

[54] STAGELESS QUICK CLAMPING HANDLE DEVICE FOR DYEING SPINDLE OF YARNCHEESE

[76] Inventor: Yung-Sho Yang, 3F, No. 20, Alley 23, Lane 281, Sec. 3, Chungyang Rd., Tucheng City, Taipe Hsien, Taiwan

[21] Appl. No.: 798,551

[22] Filed: Feb. 11, 1997

[51] Int. Cl.[6] ..... D06B 5/18; D06B 23/00

[52] U.S. Cl. ..... 68/212; 242/597.4; 68/198

[58] Field of Search ..... 68/212, 189, 198; 242/597.4, 118.41

[56] References Cited

U.S. PATENT DOCUMENTS 5,477,709 12/1995 Rowe ..... 68/212

5,590,553 1/1997 Pinckney et al. ..... 68/212

*Primary Examiner*—Philip R. Coe

[57] ABSTRACT

A stageless quick clamping handle device for dyeing spindle of yarncheese, including an upper cap, a clamping plate, a lower cap, a fitting rod, a spacer and a spindle. The clamping plate is inclinedly placed in and engaged with the upper cap and the upper cap is secured to upper side of the lower cap. The fitting rod has a fitting section at lower end and is downward sequentially snugly passed through the upper cap, the clamping plate, the lower cap and the spacer to connect with the upper end of the spindle. The spacer is permitted to freely stageless drop down due to gravity for compressing the yarncheese. Therefore, the liquid dye in the spindle is prevented from leaking. By means of the engagement between the clamping plate and fitting rod, the spacer is prevented from being lifted by the flushing force of the water coming from the pump.

10 Claims, 11 Drawing Sheets

STAGELESS QUICK CLAMPING HANDLE DEVICE FOR DYEING SPINDLE OF YARNCHEESE

BACKGROUND OF THE INVENTION

The present invention relates to a stageless quick clamping handle device for dyeing spindle of yarncheese, and more particularly to a quick clamping handle device which can freely drop down and is applicable to all kinds of spindles of yarncheese dyeing machine. The handle device includes an upper cap, a clamping plate and a lower cap which cooperate with each other, permitting the spacer to freely drop down due to gravity for compressing the yarncheese. Therefore, the liquid dye in the spindle is prevented from leaking through the clearances between the bobbine and the bottom thereof or between the bobbin and the spacer. The lower end of the fitting rod is disposed with a fitting section which can be directly fitted with the upper ends of various kinds of conventional spindles without partially cutting off the spindle and then welding the fitting rod thereon.

FIG. 1 shows a conventional handle device of a yarncheese dyeing machine for moving a spacer downward to compress the yarncheese. The peripheral face of the handle 7 is formed with multiple annular grooves with a pitch K. The spacer 71 is connected with the lower end of the handle 7. In use, after the yarncheese is fitted on the spindle 72, an excessive part of the spindle 72 is cut off and then the handle 7 is welded on the spindle 72 with the spacer 71 abutting against the top of the yarncheese so as to prevent the liquid dye from leaking out from the excessive part of the spindle, causing uneven dyeing. When the yarncheese is dyed, the weight thereof is increased and the yarncheese will slowly move down into a stack due to gravity. Moreover, when the pumped water is changed to flow from outer side to inner side, the uppermost spacer is subject to a sucking force. This makes the yarncheese drop downward. After the yarncheese moves downward by a displacement K, the handle 7 is rotated by external force and moved downward by a pitch K. After the dyeing is completed and when removing the yarncheese, the handle 7 is rotated back to its home position.

Some shortcomings exist in the above arrangement as follows:

1. After the yarncheese drops by the pitch K, an external force is exerted onto the handle to make the spacer 71 move downward for compressing the yarncheese. Even the value K is very small, the spacer 71 is still shifted downward stage by stage. Therefore, the spindle 72 is still partially exposed during some periods. Therefore, the liquid dye in the spindle will leak out from the part free from the yarncheese. As a result, the liquid dye cannot effectively infiltrate into the yarn fibers. This leads to uneven dyeing.

2. When it is desired to open the dye jar and operate the handle 7 for shifting the spacer 71 downward to compress the yarncheese, the operator is apt to be hurt by the high temperature in the dye jar.

FIGS. 2 and 3 show another type of handle device 8 for compressing the yarncheese, which includes a handle 81, a sleeve 82 and a central bar 83. The central bar 83 has a star-like shape with multiple vanes which are welded on the upper end of a star-shaped spindle. In use, the central bar 83 is sequentially downward passed through the sleeve 82, handle 81 and spacer 84 and then welded on the upper end of the spindle with the handle 81 engaged in the sleeve 82. According to such arrangement, the spacer 84 can stagelessly drop down to compress the yarncheese due to gravity. By means of operating the handle 81, the spindle with dyed yarncheese is then pulled back to its home position.

There still are some shortcomings existing in the above handle device 8 as follows:

1. The dyeing machine has various shapes and dimensions of spindles so that when welding the handle device 8 on different spindles, different shapes of central bars must be used. Also, it is still necessary to cut off the excessive part of the spindle. Moreover, the handle 81 is formed with a star-shaped slot corresponding to the central bar 83. It is difficult to process the handle 81 and mate the sleeve 82 with the handle 81.

2. When passing the central bar 83 through the handle 81, the handle 81 is in an inclined state. Therefore, a large clearance exists between the central bar 83 and the handle 81, so that when the liquid dye (water) flows from inner side to outer side, a great amount of liquid dye is apt to leak out through the clearance.

3. When the handle device 8 drops down to compress the yarncheese due to gravity, because the spacer is securely engaged with the handle 81, the flushing force of the water of the pump tends to lift the spacer. Therefore, the spacer can be hardly stably located.

SUMMARY OF THE INVENTION

In order to obviate the above problems, it is a primary object of the present invention to provide a stageless quick clamping handle device for dyeing spindle of yarncheese, including an upper cap, a clamping plate engaged in the upper cap, a lower cap and a fitting rod passed through the upper cap, clamping plate, lower cap and the spacer, to connect with the upper end of the spindle. The spacer is permitted to freely stageless drop down due to gravity for compressing the yarncheese. Therefore, the liquid dye in the spindle is prevented from leaking.

It is a further object of the present invention to provide the above handle device in which the clamping plate is formed with a central hole which can have a circular shape. Therefore, it is easy to process the clamping plate and fit the fitting rod into the clamping plate. In addition, the peripheral wall of the central hole are formed with opposite notches providing four engaging points to reliably clamp the fitting rod. Therefore, when the spacer moves downward, the spacer is prevented from being lifted by the flushing force of the water of the pump.

It is still a further object of the present invention to provide the above handle device in which the fitting rod is cylindrically shaped, whereby the clearance between the peripheral wall of the central hole of the lower cap and the fitting rod is reduced to 0.08–0.18 mm.

Therefore, the leakage of the liquid dye is minimized. Moreover, the lower end of the fitting rod is formed with a fitting section which can be easily fitted with the upper ends of various kinds of conventional spindles without cutting off the excessive part. Therefore, the time for connecting the fitting rod with the spindle is saved.

The present invention can be best understood through the following description and accompanying drawings, wherein:

DETAILED DESCRIPTION OF PREFERRED EMBODIMENTS

Figure 1:
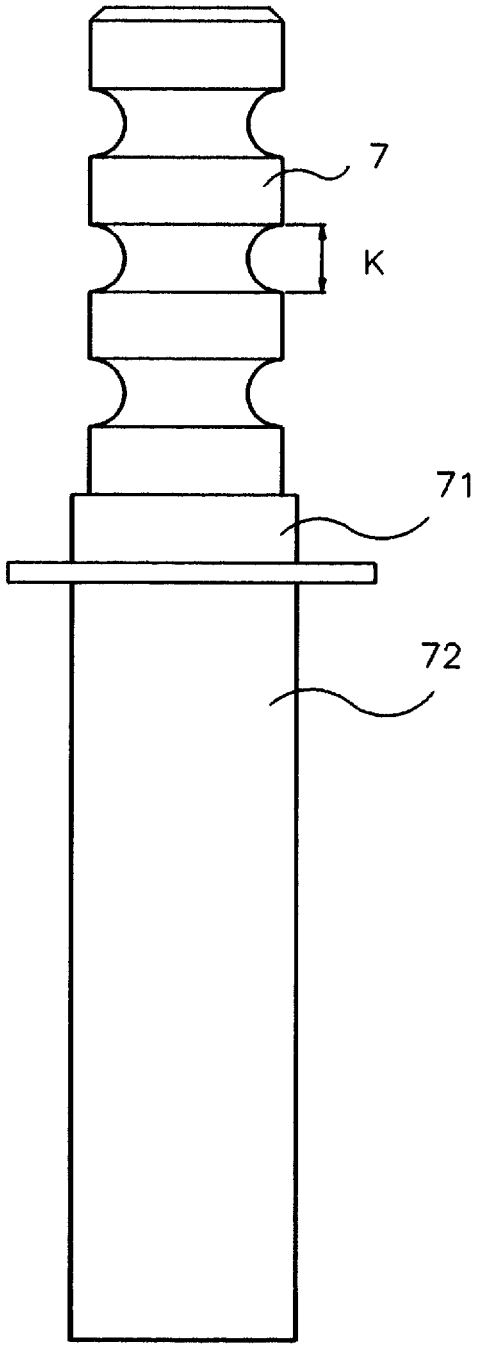
Fig. 1 Prior Art
FIG. 1 is a perspective view of a conventional handle structure for dyeing spindle of yarncheese.
Figure 2:
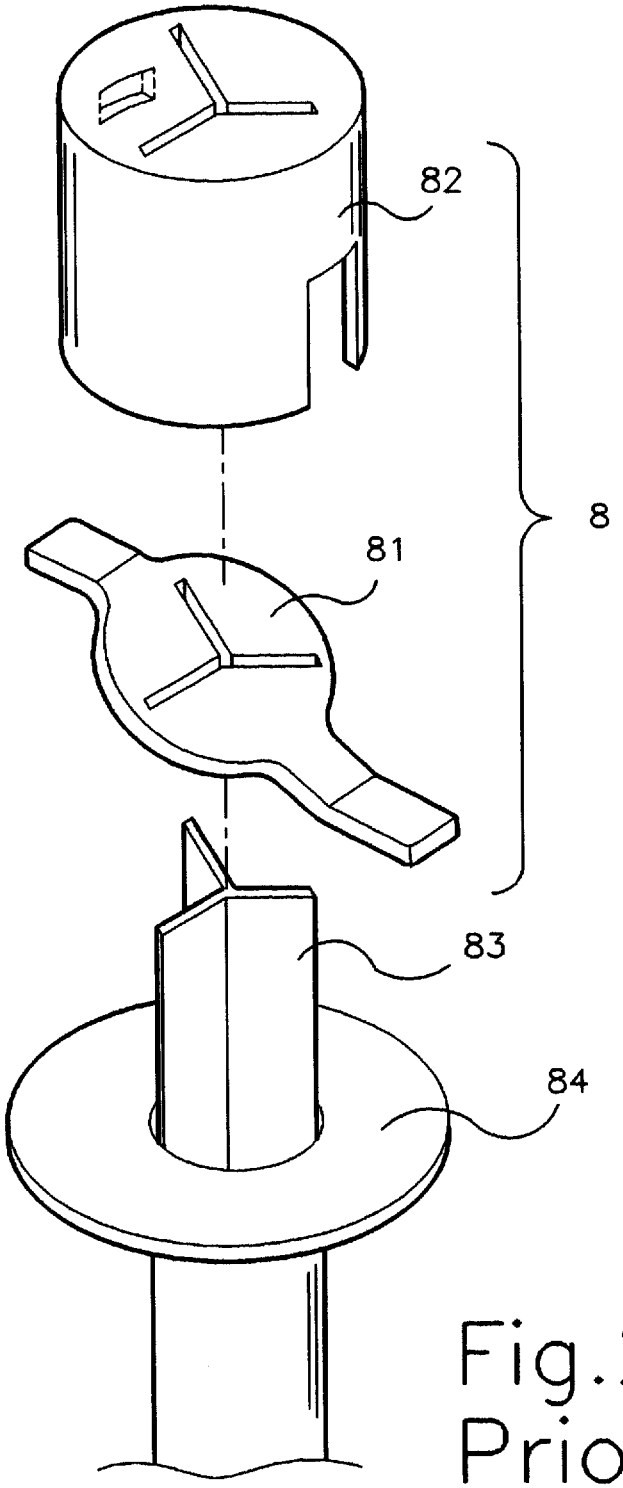
Fig.2 Prior Art
FIG. 2 is a perspective exploded view of another conventional handle device of dyeing spindle of yarncheese.
Figure 3:
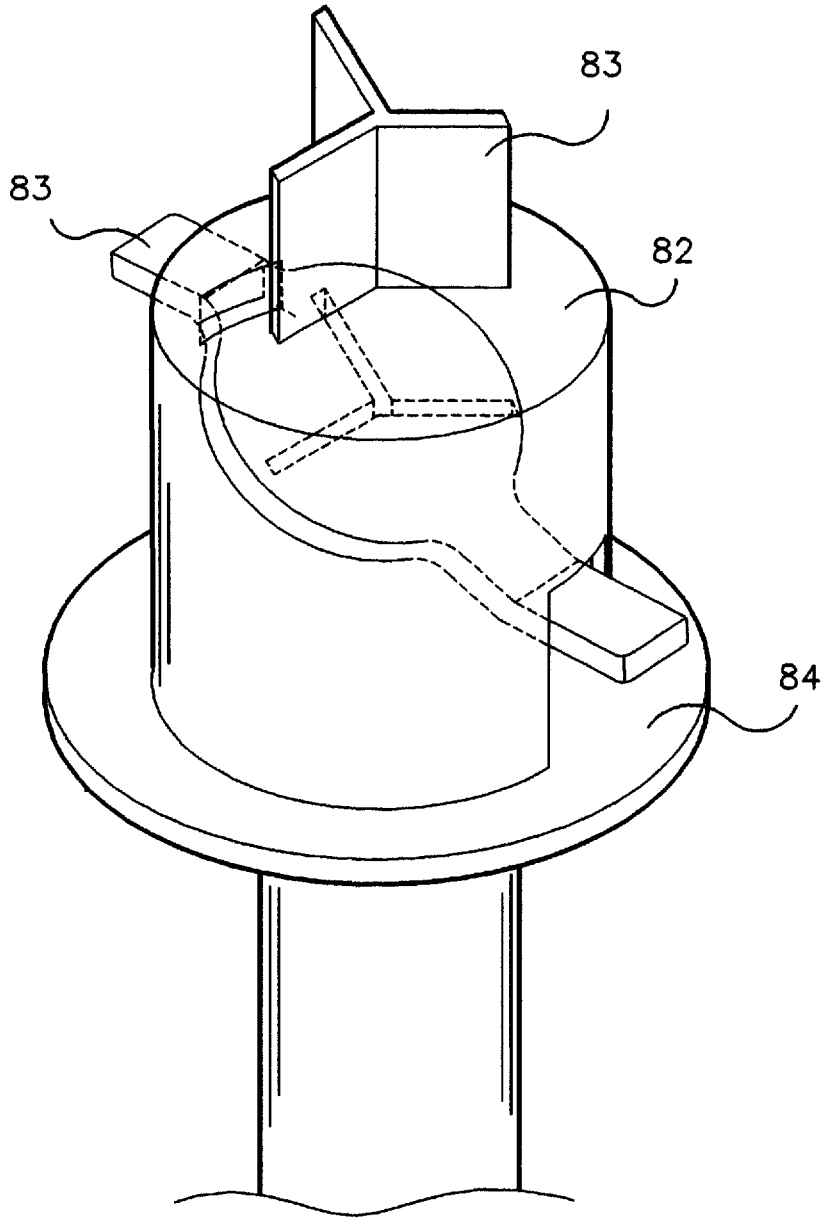
Fig.3 Prior Art
FIG. 3 is a perspective assembled view according to FIG. 2.
Figure 4:
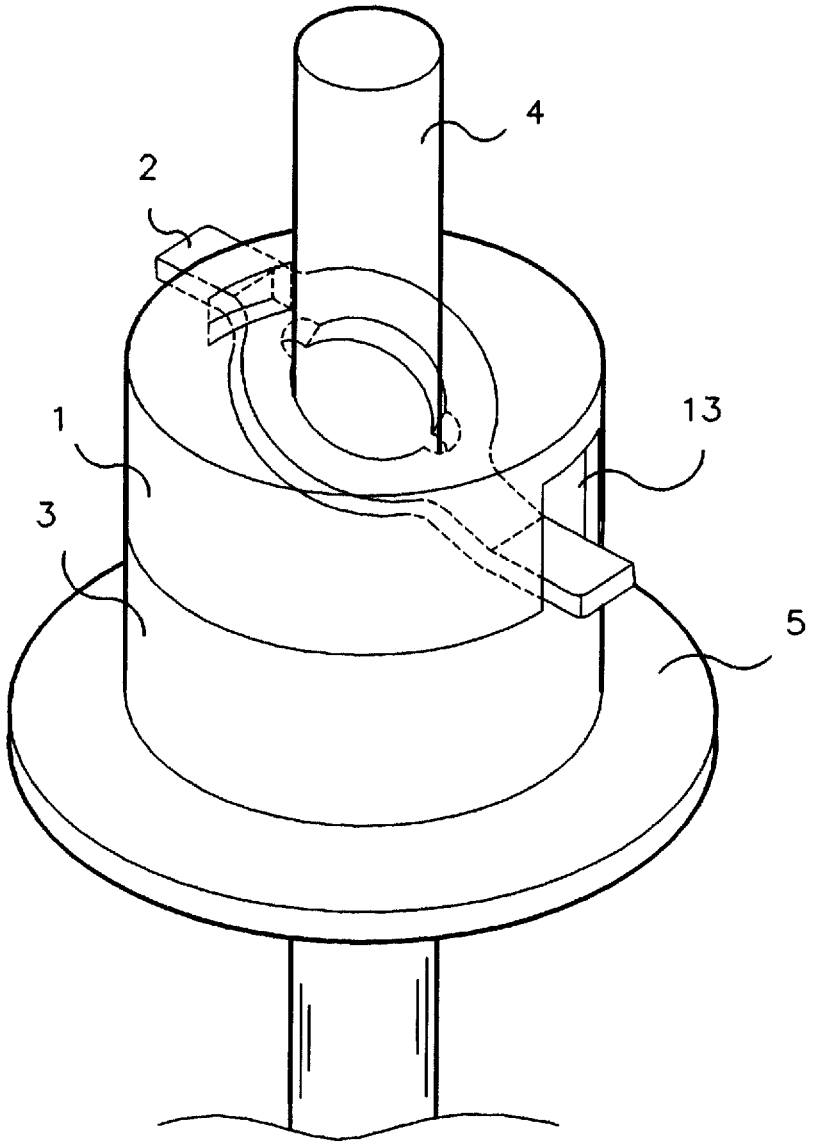
FIG. 4 is a perspective assembled view of a first embodiment of the present invention.
Figure 5:
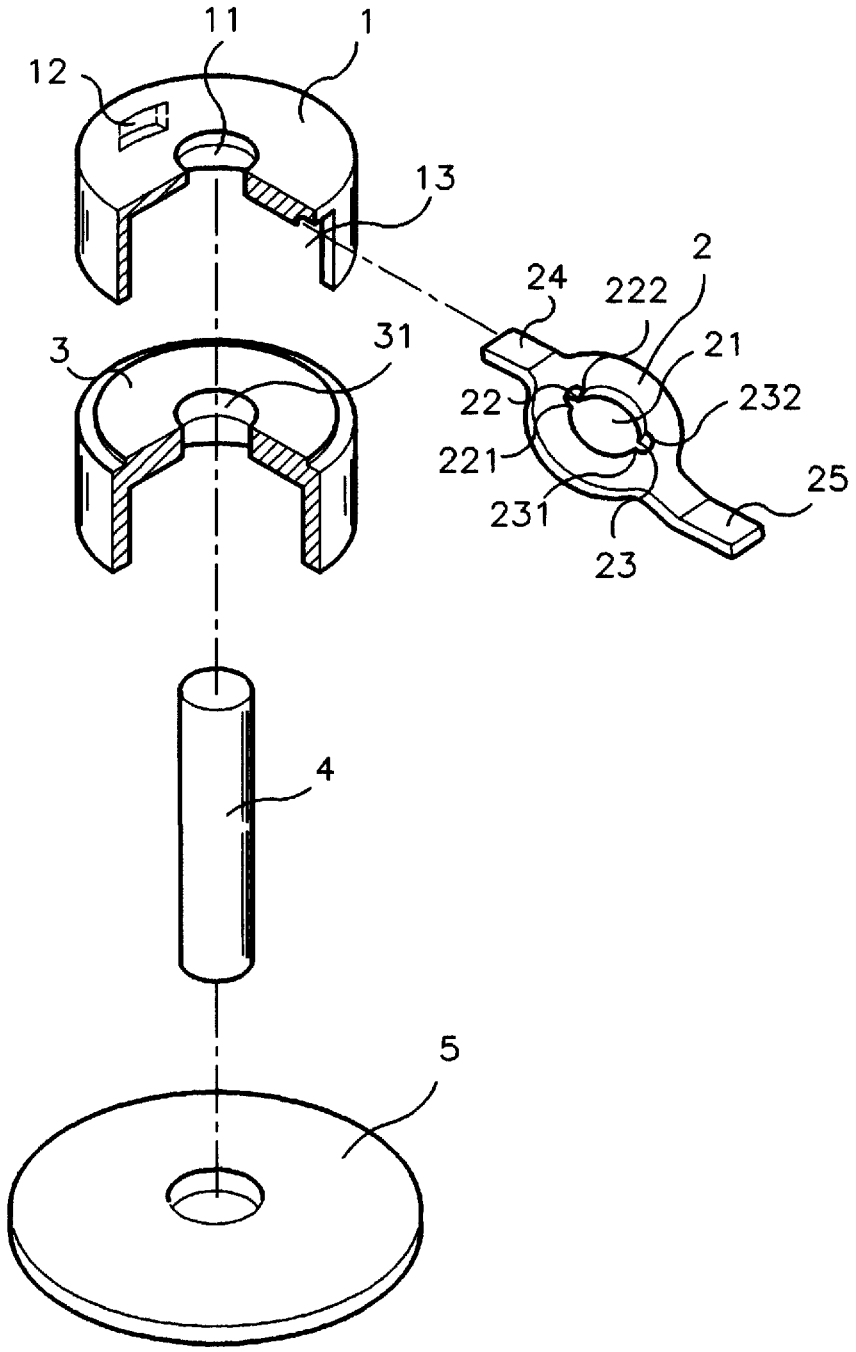
FIG. 5 is a perspective exploded view of the first embodiment of the present invention.
Figure 5A:
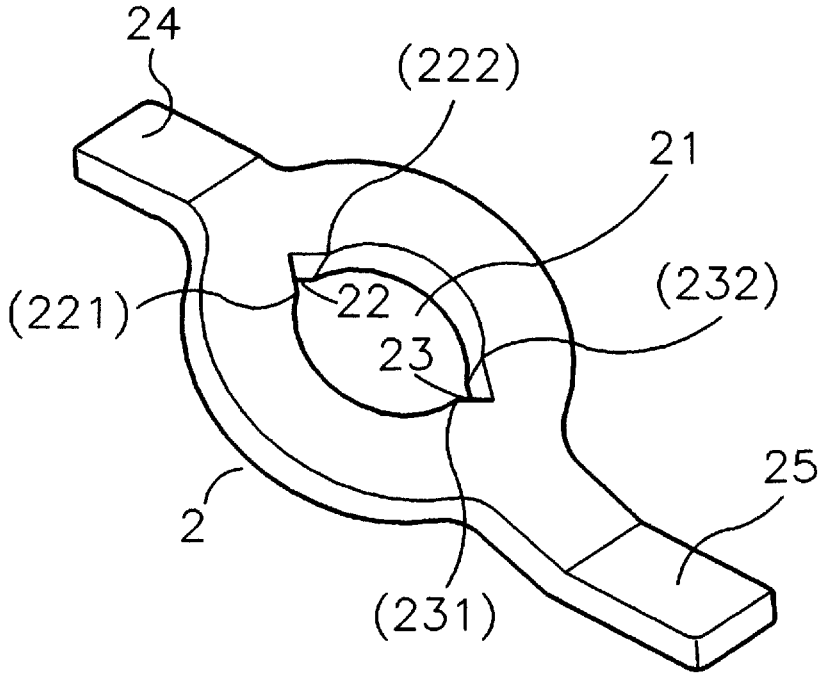
FIGS. 5A, 5B and 5C show alternative notch configurations for the camping plate.
Figure 5B:
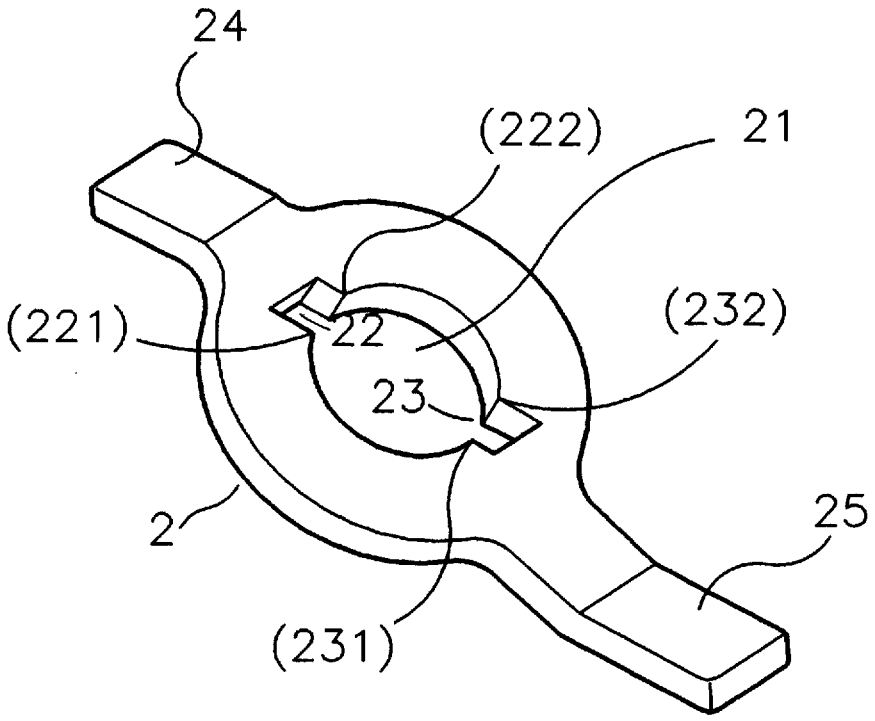
Figure 5C:
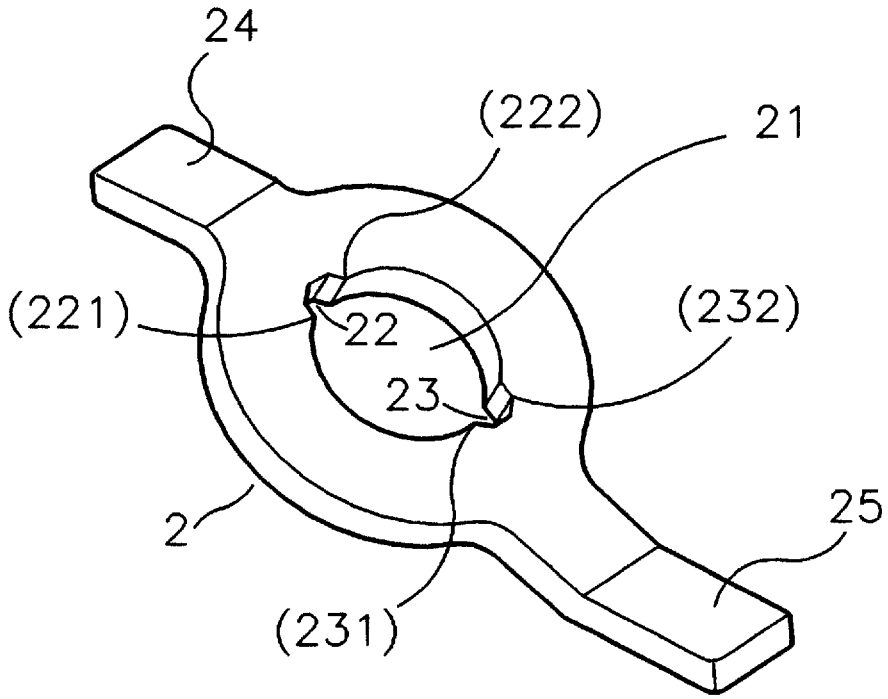

Please refer to FIGS. 4 and 5. The present invention mainly includes an upper cap 1, a clamping plate 2, a lower cap 3, a fitting rod 4 and a spacer 5. The upper cap 1 is formed with a central hole 11. In addition, the peripheral wall of the upper cap 1 is formed with an engaging window 12 and a handle opening 13 opposite to each other. The clamping plate 2 is formed with a central hole 21 which can have a circular shape for easy processing and fitting with the fitting rod 4. The peripheral wall of the central hole 21 is formed with two opposite notches 22, 23 at two ends of a longitudinal axis. The notches 22, 23 can be of a semicircular arch configuration, as shown in FIGS. 4 and 5, and may also be of other configurations, such as triangular, rectangular or polygonal notches as shown in FIGS. 5A, 5B and 5C, forming four engaging points 221, 222, 231, 232 providing clamping effect, whereby when the clamping plate 2 is inclined, the fitting rod 4 is engaged therewith and prevented from being shifted upward. The clamping plate 2 has a fulcrum end 24 passing through the engaging window 12 and a free end 25 passing through the handle opening 13. The lower cap 3 is also formed with a central hole 31 corresponding to the central hole 11 of the upper cap 1. When assembled, the clamping plate 2 is placed into the upper cap 1 with the fulcrum end 24 extending through the engaging window 12 and the free end 25 protruding out of the handle opening 13. Then the upper cap 1 is secured on the upper side of the lower cap 3 and the fitting rod 4 is downward sequentially snugly passed through the central hole 11 of the upper cap 11, the central hole 21 of the clamping plate 2 and the central hole 31 of the lower cap 3 and positioned between the lower cap 3 and the spacer 5. Then the fitting rod 4 is connected with the upper end of the spindle 6. At this time, the clamping plate 2 is subject to gravity and inclined by a certain angle, whereby the fitting rod 4 is engaged with the engaging points of the central hole 21 and stably prevented from being shifted upward. When the dyeing procedure is completed, the free end 25 of the clamping plate 2 is pulled upward through a certain angle so as to shift the spindle 6 to its home position as shown in FIG. 7.

Figure 6:
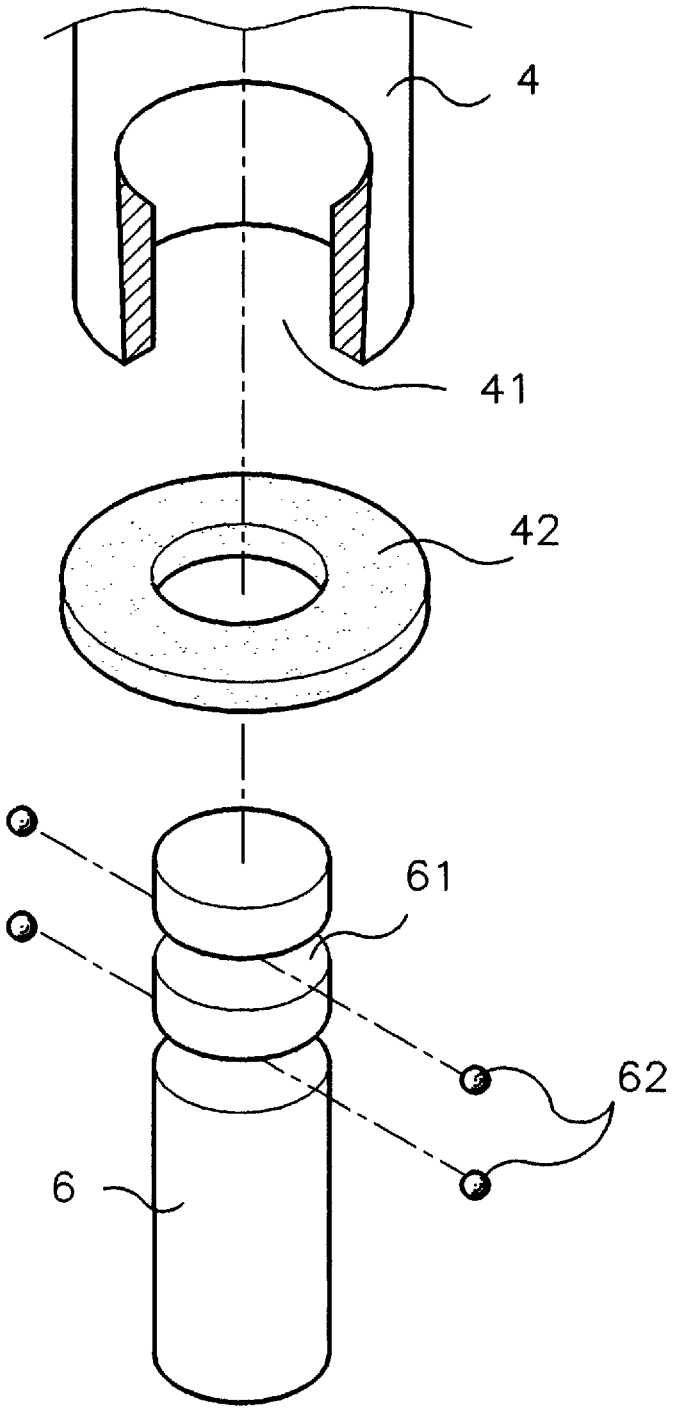
FIG. 6 is a partially perspective exploded view of a second embodiment of the present invention, showing the fitting section of the fitting rod.
Figure 7:
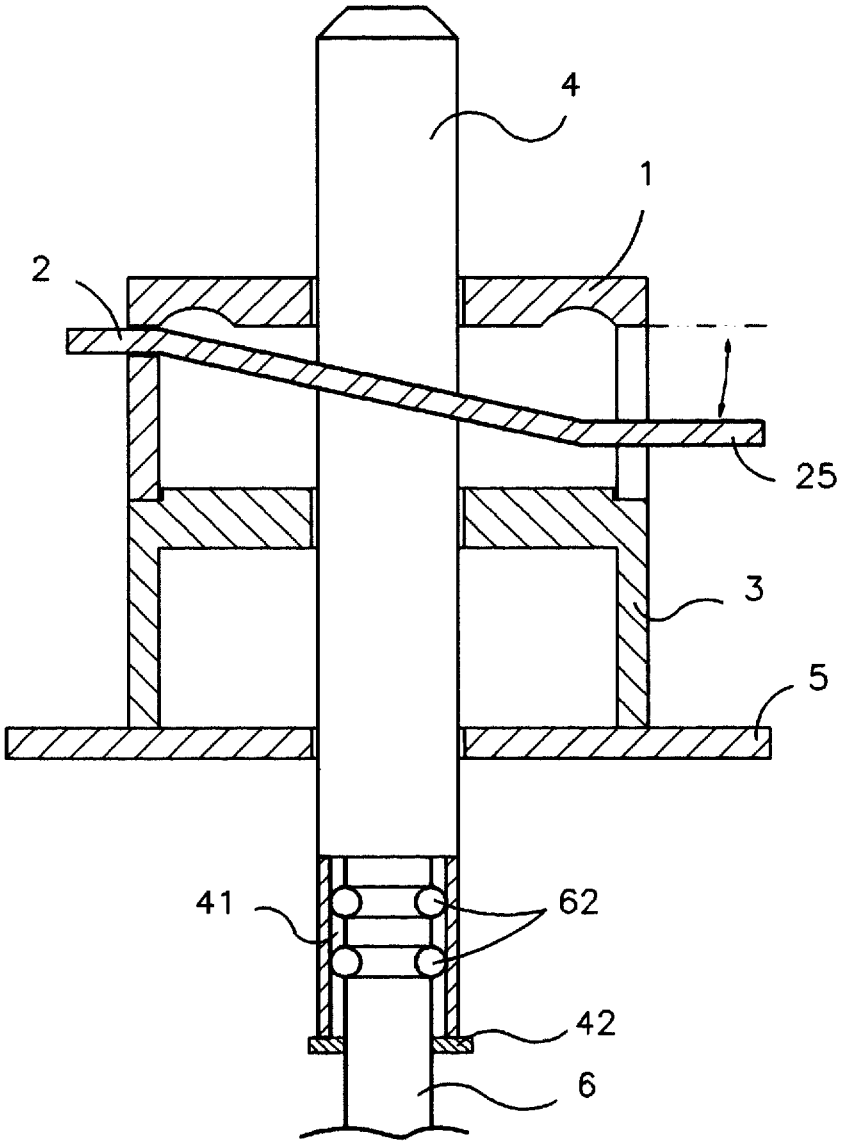
FIG. 7 is a sectional view according to FIG. 6.

Referring to FIGS. 6 and 7, the lower end of the fitting rod 4 is formed with a hollow fitting section 41 having an inner diameter larger than outer diameter of the spindle 6. The peripheral face of upper end of the spindle 6 is formed with at least one annular groove 61 for receiving multiple ball members. A ring-like disk 42 is fitted around the spindle 6 below the annular groove 61 and then the fitting section 41 is fitted around the ball members 62 and secured on the disk 42. The disk 42 abuts against the ball members 62, whereby the fitting section 41 can be securely, quickly and smoothly fitted on the spindle 6. Alternatively, the fitting section 41 can be formed with inner thread, while the upper end of the spindle 6 is formed with outer thread, whereby the fitting section 41 can be directly screwed on the spindle 6.

Figure 8B:
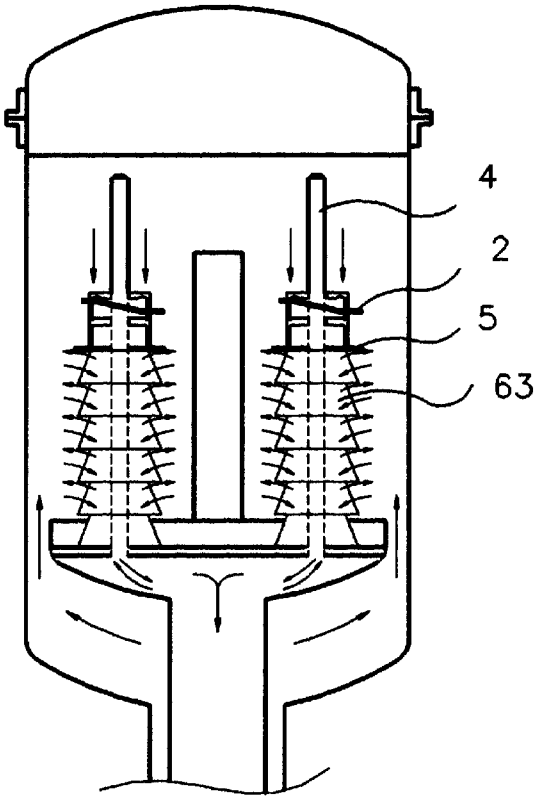
FIG. 8B shows the operation of the present invention in the yarncheese dyeing machine after dyeing.
Figure 8A:
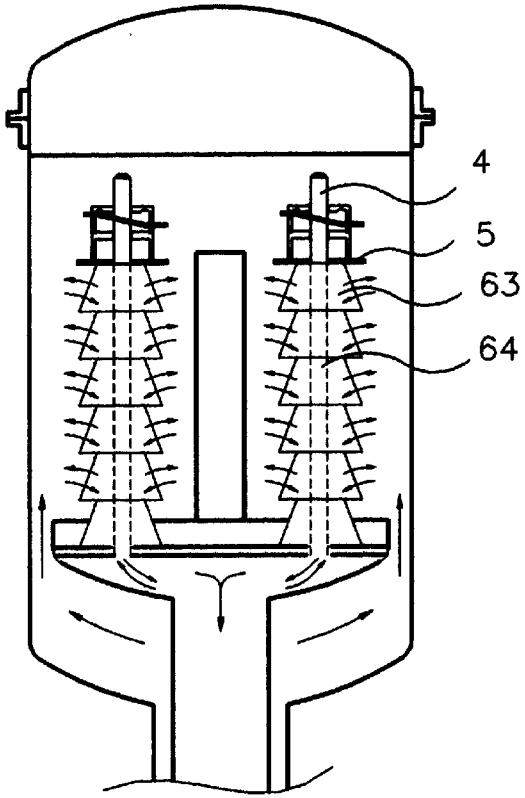
FIG. 8A shows the operation of the present invention in the yarncheese dyeing machine prior to dyeing.

Referring to FIGS. 8A and 8B, the spindle 6 is installed in a sleeve 64, while the yarncheese 63 is fitted around the sleeve 64. After the yarncheese 63 is dyed, the weight thereof is increased. Due to gravity, the yarncheese will slowly move downward. At this time, the spacer 5 for compressing the yarncheese 63 is also subject to the gravity and freely drops downward to compress the yarncheese. Therefore, the liquid dye in the spindle 6 is prevented from leaking. In addition, by means of the engagement of the engaging points 221, 222, 231, 232 of the clamping plate 2, the spacer 5 will not be lifted by the flushing force of the water coming from the pump.

According to the above arrangement, the stageless quick clamping handle device of the present invention is able to accurately compress the yarncheese without leakage. In addition, the handle device is applicable to all conventional spindles with various shapes.

It should be noted that the above description and accompanying drawings are only used to illustrate some embodiments of the present invention, not intended to limit the scope thereof. Any modification of the embodiments should fall within the scope of the present invention.

What is claimed is:

1. A stageless quick clamping handle device for dyeing spindle of yarncheese, comprising an upper cap, a clamping plate, a lower cap, a fitting rod, a spacer and a spindle, wherein:

the upper cap is formed with a central hole and a peripheral wall of the upper cap is formed with an engaging window and a handle opening opposite to each other;

the clamping plate is placed in the upper cap and formed with a central hole, the clamping plate having a fulcrum end passing through the engaging window and a free end passing through the handle opening for a user to pull the clamping plate; and the lower cap is formed with a central hole corresponding to the central hole of the upper cap, whereby when assembled, the clamping plate is placed in the upper cap with the fulcrum end extending through the engaging window and the free end protruding out of the handle opening and then the upper cap is secured on the upper side of the lower cap and the fitting rod is downward sequentially snugly passed through the central hole of the upper cap, the central hole of the clamping plate and the central hole of the lower cap and the spacer to connect with the upper end of the spindle.

2. A handle device as claimed in claim 1, wherein a peripheral wall of the central hole of the clamping plate is formed with opposite notches for engaging with the fitting rod and shifting the fitting rod upward.

3. A handle device as claimed in claim 2, wherein the notches of the central hole of the clamping plate are arch notches.

4. A handle device as claimed in claim 2, wherein the notches of the central hole of the clamping plate are triangular notches.

5. A handle device as claimed in claim 2, wherein the notches of the central hole of the clamping plate are rectangular notches.

6. A handle device as claimed in claim 2, wherein the notches of the central hole of the clamping plate are polygonal notches.

7. A handle device as claimed in claim 2, wherein a lower end of the fitting rod is formed with a hollow fitting section having an inner diameter larger than outer diameter of the spindle for fitting with the upper end of the spindle.

8. A handle device as claimed in claim 7, wherein a peripheral face of upper end of the spindle is formed with at least one annular groove for receiving multiple ball members, whereby the fitting section can be securely and smoothly fitted with the upper end of the spindle.

9. A handle device as claimed in claim 1, wherein a lower end of the fitting rod is formed with a hollow fitting section having an inner diameter larger than outer diameter of the spindle for fitting with the upper end of the spindle.

10. A handle device as claimed in claim 9, wherein a peripheral face of upper end of the spindle is formed with at least one annular groove for receiving multiple ball members, whereby the fitting section can be securely and smoothly fitted with the upper end of the spindle.

* * * * *